US006659713B1

(12) United States Patent
Fujii et al.

(10) Patent No.: US 6,659,713 B1
(45) Date of Patent: Dec. 9, 2003

(54) FLUID PUMPS

(75) Inventors: Shinichi Fujii, Obu (JP); Seiji Murase, Obu (JP)

(73) Assignee: Aisin Kogyo Kabushiki Kaisha, Obu (JP)

( * ) Notice: Subject to any disclaimer, the term of this patent is extended or adjusted under 35 U.S.C. 154(b) by 0 days.

(21) Appl. No.: 09/890,268

(22) PCT Filed: Jan. 28, 2000

(86) PCT No.: PCT/JP00/00485

§ 371 (c)(1),
(2), (4) Date: Nov. 28, 2001

(87) PCT Pub. No.: WO00/47898

PCT Pub. Date: Aug. 17, 2000

(30) Foreign Application Priority Data

Feb. 9, 1999 (JP) ..... 11-031710

(51) Int. Cl.[7] ..... F01D 1/12

(52) U.S. Cl. ..... 415/55.1; 415/200; 415/186; 416/241 A; 417/423.3; 417/423.14

(58) Field of Search ..... 415/55.1–55.7, 415/200, 186, 187, 208.5, 169.1, 169.2, 237; 416/241 A, 237; 417/423.3, 423.4

(56) References Cited

U.S. PATENT DOCUMENTS

| | | | | |
|---|---|---|---|---|
| 5,310,308 A | | 5/1994 | Yu et al. | |
| 5,401,147 A | * | 3/1995 | Yu | 417/423.14 |
| 5,472,321 A | * | 12/1995 | Radermacher | 417/365 |
| 5,498,124 A | | 3/1996 | Ito et al. | |
| 5,551,842 A | * | 9/1996 | Schmid et al. | 417/203 |
| 5,558,490 A | * | 9/1996 | Dobler et al. | 415/55.1 |
| 5,702,229 A | * | 12/1997 | Moss et al. | 415/55.4 |
| 5,716,191 A | | 2/1998 | Ito et al. | |
| 5,807,068 A | | 9/1998 | Dobler et al. | |
| 5,921,746 A | * | 7/1999 | Yu et al. | 415/55.1 |
| 6,224,323 B1 | * | 5/2001 | Murase et al. | 415/55.1 |
| 6,527,506 B2 | * | 3/2003 | Pickelman et al. | 415/55.1 |

FOREIGN PATENT DOCUMENTS

| | | |
|---|---|---|
| DE | 4427874 | 8/1996 |
| EP | 0931927 | 7/1999 |
| JP | 58151397 | 11/1983 |
| JP | 6159283 | 6/1994 |

* cited by examiner

*Primary Examiner*—Edward K. Look
*Assistant Examiner*—J. M. McAleenan
(74) *Attorney, Agent, or Firm*—Dennison, Schultz & Dougherty

(57) ABSTRACT

Impeller 21 is rotatably disposed within a pump housing that includes pump cover 5 and pump body 18. Inlet port 19, body groove 31, partition 33 and blocking wall 37 are formed in the pump body 18. The body groove 31 defines a first pump channel 35, and the blocking wall 37 defines a enlarged channel portion 38. Outlet port 20, cover groove 32 and partition 34 are formed in the pump cover 5. The cover groove 32 defines a second pump channel 36. Distance ① between a terminal end of the first pump channel 35 and a terminal end of the outlet port 20, distance ② between a starting end of the enlarged channel portion 38 and a starting end of the second pump channel 36, length ③ of the partition 34 and length ④ of the partition 33 each are chosen to be optimum values such that the amount of fluid that is discharged through the outlet port 20 and the amount of fluid that flows in though the inlet port 19 increase.

26 Claims, 10 Drawing Sheets

FLUID PUMPS

FIELD OF THE INVENTION

The present invention relates to fluid pumps for supplying a fluid, and more particularly, to fluid pumps that are used as fuel pumps for supplying fuel from a fuel tank to an engine.

BACKGROUND OF THE INVENTION

An example of a fuel pump is disclosed in Japanese Laid-Open Patent Publication No. 8-14184, which is an in-tank fuel pump disposed within a fuel tank.

In this known fuel pump, an impeller is mounted on a shaft of a motor and is rotatably disposed within a pump housing. Blades are formed within both axial end surfaces of the impeller and are disposed at a predetermined pitch along the perimeter of the impeller. A blade groove is formed between each of the blades. The pump housing has an inlet port through which fuel flows in, an outlet port through which fuel is discharged, a pump channel and a partition. The inlet port is formed on one axial side of the impeller. The outlet port is formed on the other axial side of the impeller. The pump channel extends from the inlet port to the outlet port along a travelling path of the impeller blades. The partition is formed between the inlet port and the outlet port. The pump channel includes a first pump channel and a second pump channel. The first pump channel faces one end surface of the impeller on the side of the inlet port. The second pump channel faces the other end surface of the impeller on the side of the outlet port. In this known fuel pump, a terminal end of the outlet port is located at a position displaced by one-half of the pitch of the blades from a terminal end of the first pump channel downstream in the direction of rotation of the impeller. Further, a starting end of the second pump channel is located at a position displaced by one-half of the pitch of the blades from a starting end of the inlet port downstream in the direction of rotation of the impeller.

In fuel pumps that are typically used, one-half of the pitch of the blades is about 10° or less. Specifically, in this case, the terminal end of the outlet port is located at a position displaced at a maximum of about 10° from the terminal end of the first pump channel downstream in the direction of rotation of the impeller. The starting end of the second pump channel is located at a position displaced at a maximum of about 10° from the starting end of the inlet port downstream in the direction of rotation of the impeller.

Fuel that flows through the second pump channel is directly discharged through the outlet port. Further, fuel flowing through the first pump channel is drawn from near the terminal end of the first pump channel to the second pump channel and then discharged through the outlet port. In the known fuel pump, if the rotational speed (peripheral velocity) of the impeller is high, fuel flowing through the first pump channel will pass a position corresponding to the outlet port before flowing from near the terminal end of the first pump channel to the second pump channel. Therefore, the known fuel pump cannot increase fuel discharge, thus preventing an increase in the pump efficiency.

Further, some of the fuel within the blade grooves is not discharged through the outlet port. Such fuel is drawn toward the inlet port while being confined within the blade grooves by the partitions. The fuel that is confined within the blade grooves by the partitions is highly pressurized. Therefore, after having passed along the partitions, such fuel is ejected into the second pump channel and the inlet port at the starting end of the second pump channel and the starting end of the inlet port. In the known fuel pump, the high-pressure fuel that has been confined within the blade grooves flows back into the inlet port and collides with fuel that flows in through the inlet port. Therefore, the known fuel pump cannot increase the amount of fuel that flows in through the inlet port, thus preventing an increase in the pump efficiency.

DISCLOSURE OF THE INVENTION

It is, accordingly, an object of the present invention to provide a fluid pump having increased pump efficiency.

One means for attaining this object is to adjust the distance between a terminal end of the outlet port and a terminal end of the first pump channel provided on the side of the inlet port. Preferably, the terminal end of the outlet port is located at a position displaced about 25° to 60° from the terminal end of the first pump channel in the direction of rotation of the impeller. With this construction, the fluid that flows through the first pump channel can be reliably discharged through the outlet port even when the rotational speed of the impeller is high. Thus, the pump efficiency can be increased.

Another means for attaining this object is to provide an enlarged channel portion that is defined between a partition and a channel communicating portion at which the first pump channel communicates with the inlet port. The enlarged channel portion has a larger flow passage area than a flow passage area decreased by the partition. In this case, the distance between a starting end of the second pump channel and a starting end of the enlarged channel portion is preferably adjusted. Thus, the starting end of the second pump channel is preferably located at a position displaced about 8° to 30° from the starting end of the enlarged channel portion in the direction of rotation of the impeller. With this construction, the high-pressure fuel that has been confined within the blade grooves can be prevented from flowing back into the inlet port. Further, negative pressure can be increased in the channel communicating portion on the side of the inlet port. Thus, the amount of fluid that flows in through the inlet port can be increased, thereby improving the pump efficiency.

A further means for attaining this object is to adjust the length of the partition formed on the side of the second pump channel. Preferably, the angular length of the partition formed on the side of the second pump channel is chosen to be between about 25° to 45°. With this construction, the relationship between the length (sealing width) of the partition and the flow passage length of the second pump channel can be optimized, so that the pump efficiency can be increased.

A still further means for attaining this object is to adjust the length of the partition formed on the side of the first pump channel. Preferably, the angular length of the partition formed on the side of the first pump channel is chosen to be between about 60° to 80°. With this construction, the relationship between the length (sealing width) of the partition and the flow passage length of the first pump channel can be optimized, so that the pump efficiency can be increased.

Additional objects, features and advantages of the present invention will be readily understood after reading the following detailed description together with the accompanying drawings and the claims.

BEST MODES FOR PERFORMING THE INVENTION

Figure 1:
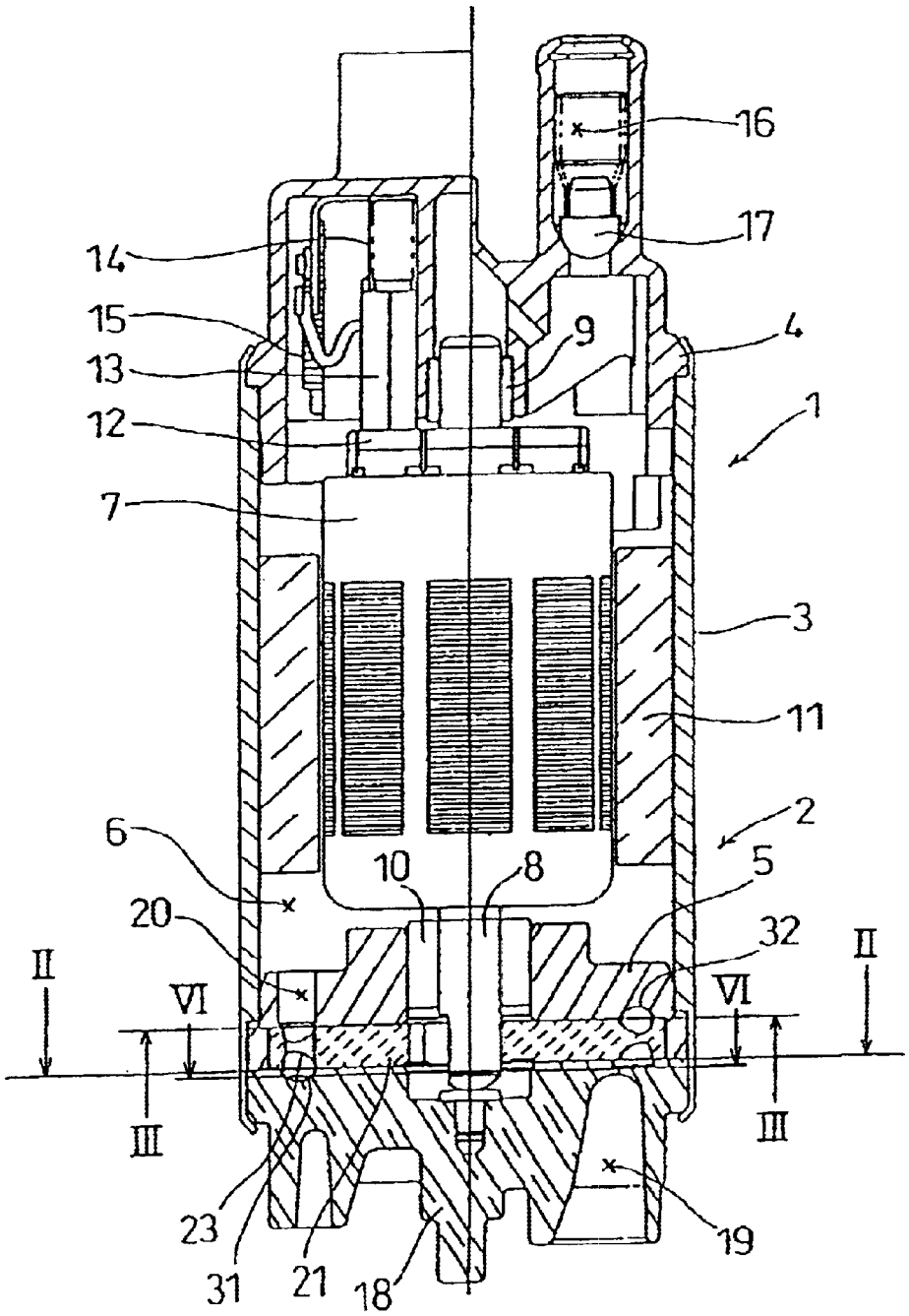
FIG. 1 is a sectional view of a fluid pump according to a preferred embodiment of the present invention.

Typically, fluid pumps include an impeller having blade grooves formed along a perimeter of the impeller and a pump housing covering the impeller. The pump housing has an inlet port formed on one axial side of the impeller, an outlet port formed on the other axial side of the impeller, a pump channel extending between the inlet port and the outlet port along a travelling path of the blade grooves, and a partition formed between the inlet port and the outlet port. Further, the pump channel has a first pump channel that faces one end surface of the impeller on the side of the inlet port and a second pump channel that faces the other end surface of the impeller on the side of the outlet port.

Fluid is drawn into the inlet port and flows toward the outlet port along the first pump channel or the second pump channel via the impeller. Fluid within the second pump channel is directly discharged through the outlet port. Further, fluid within the first pump channel is drawn into the second pump channel and is then discharged through the outlet port. At this time, if the peripheral velocity of the impeller is higher than the flow velocity at which the fuel within the first pump channel flows toward the second pump channel, the fuel within the first pump channel will not be drawn into the second pump channel. Such fuel will pass along the partitions while being confined within the blade grooves. In one aspect of the present invention, the distance between the terminal end of the first pump channel and the terminal end of the outlet port is adjusted. Preferably, the distance between the terminal end of the first pump channel and the terminal end of the outlet port is chosen to be between about 25° to 60° .

Further, some of the fuel within the blade grooves is not discharged through the outlet port, but is instead confined within the blade grooves. In this state, the fuel is highly pressurized and passes along the partitions. The high-pressure fuel is then ejected into the channel communicating portion at which the first pump channel communicates with the inlet port. If the high-pressure fuel that has been ejected into the channel communicating portion flows back into the inlet port, the high-pressure fuel will collide with fuel that flows in through the inlet port. This collision will cause a reduction of the amount of fuel that flows in through the inlet port. In another aspect of the invention, the enlarged channel portion is formed in the partition that is formed on the side of the inlet port and located in the wall surface adjacent to the inlet port. Further, if the distance between the starting end of the enlarged channel portion and the starting end of the second pump channel is close, the high-pressure fuel that has been confined within the blade grooves will be ejected substantially at the same time into the enlarged channel portion and the second pump channel. In this case, negative pressure will be reduced in the channel communicating portion on the side of the inlet port, which reduces the amount of fuel that flows in through the inlet port. Therefore, in a further aspect of the invention, the distance between the starting end of the enlarged channel portion and the starting end of the second pump channel is adjusted. Preferably, the distance between the starting end of the enlarged channel portion and the starting end of the second pump channel is chosen to be between about 8° to 30°.

Further, if the flow passage lengths of the pump channels are increased, the pump efficiency will be increased. On the other hand, if the length (sealing width) of the partition is shortened, a greater amount of fuel will leak from the outlet port side to the inlet port side via the partition. As a result, the pump efficiency will be reduced. Therefore, in a still further aspect of the invention, the length of the partition formed on the side of the first pump channel or the length of the partition formed on the side of the second pump channel is adjusted. Preferably, the length of the partition formed on the side of the first pump channel is chosen to be between about 60° to 80°. Further, the length of the partition formed on the side of the second pump channel is chosen to be between about 25° to 45°.

Representative examples of the present invention will now be described in detail with reference to the attached drawings. This detailed description is merely intended to teach a person of skill in the art further details for practicing preferred aspects of the present teachings and is not intended to limit the scope of the invention.

Figure 2:
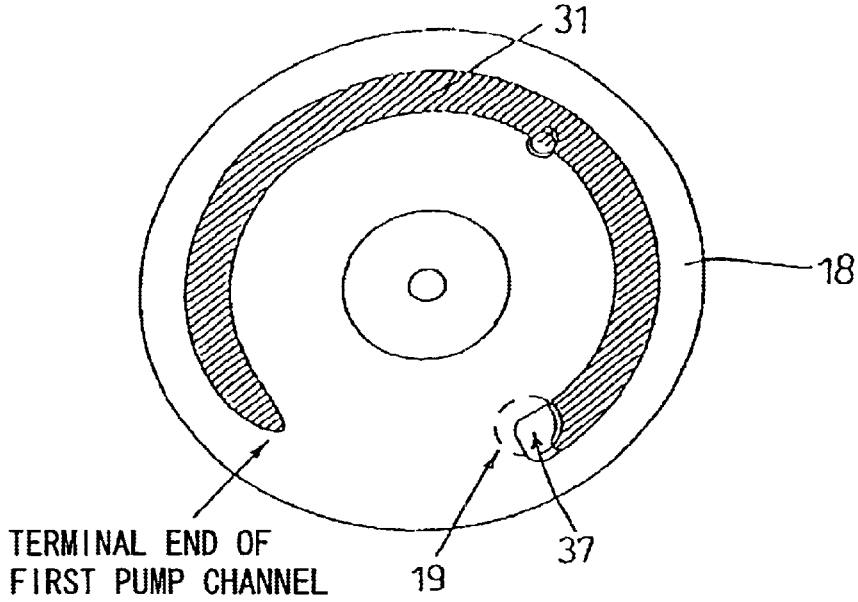
FIG. 2 is a sectional view taken along line II—II shown in FIG. 1.
Figure 3:
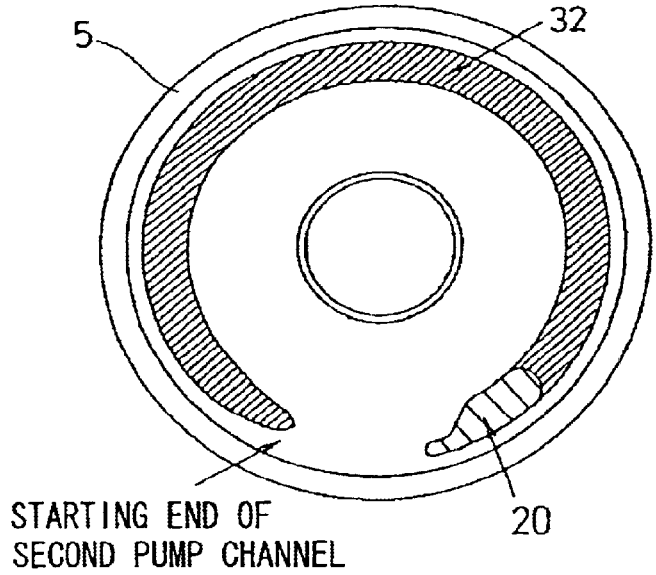
FIG. 3 is a sectional view taken along line III—III shown in FIG. 1.
Figure 4:
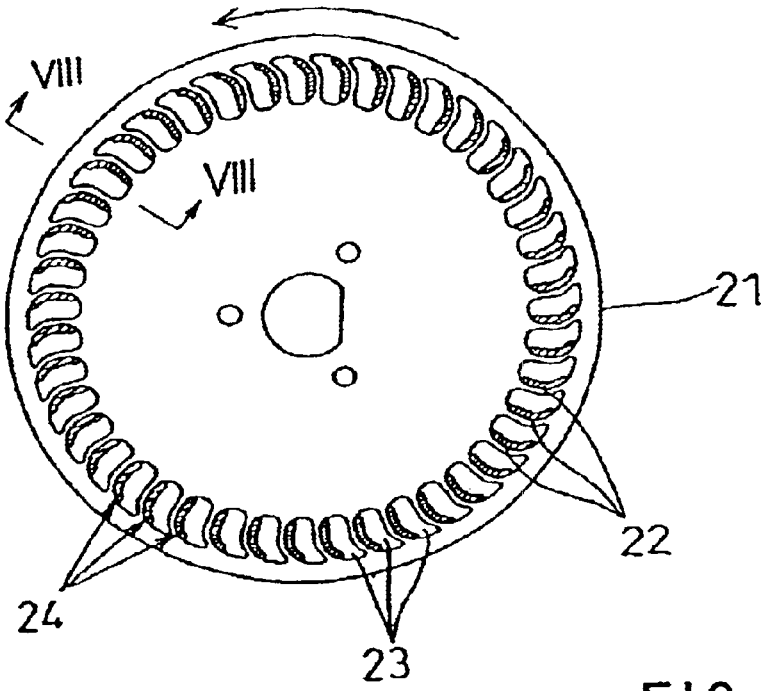
FIG. 4 is a plan view as viewed from one side of an impeller.
Figure 5:
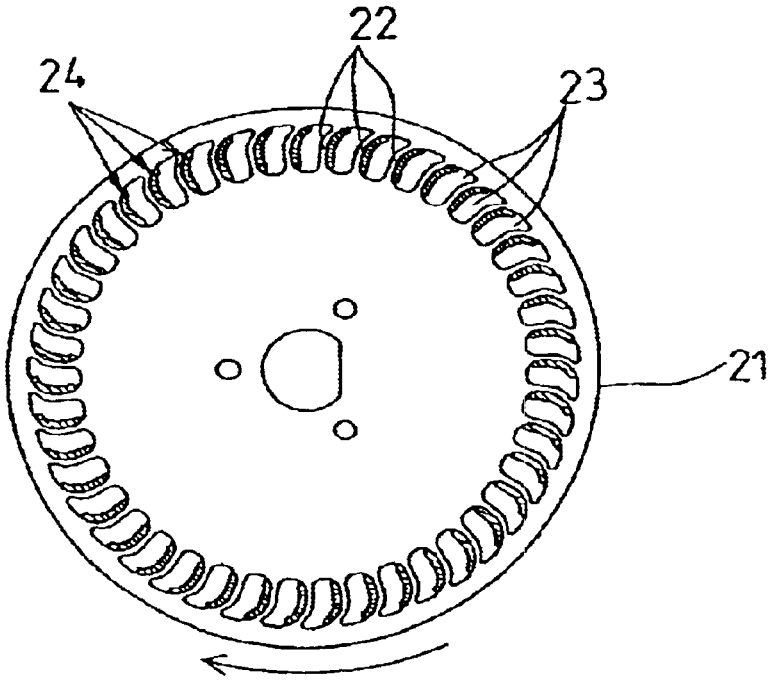
FIG. 5 is a plan view as viewed from the other side of the impeller.
Figure 6:
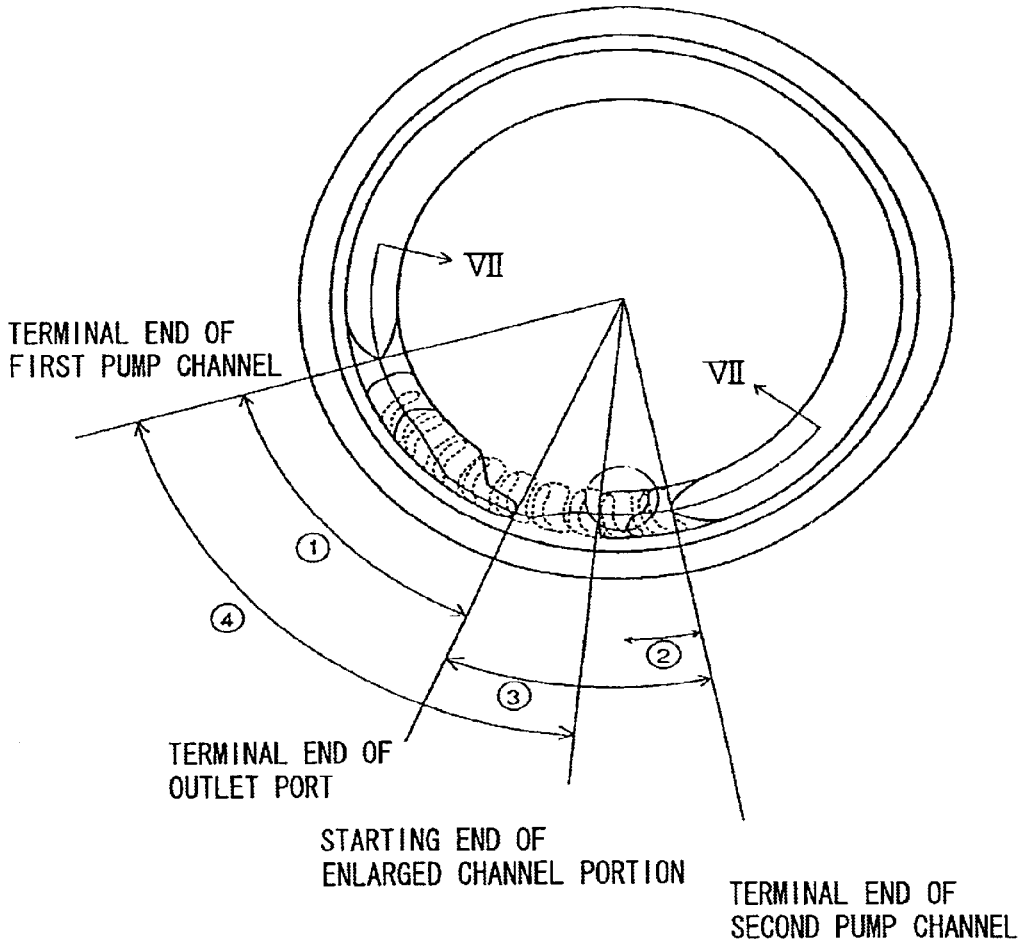
FIG. 6 is a sectional view taken along line VI—VI shown in FIG. 1.
Figure 7:
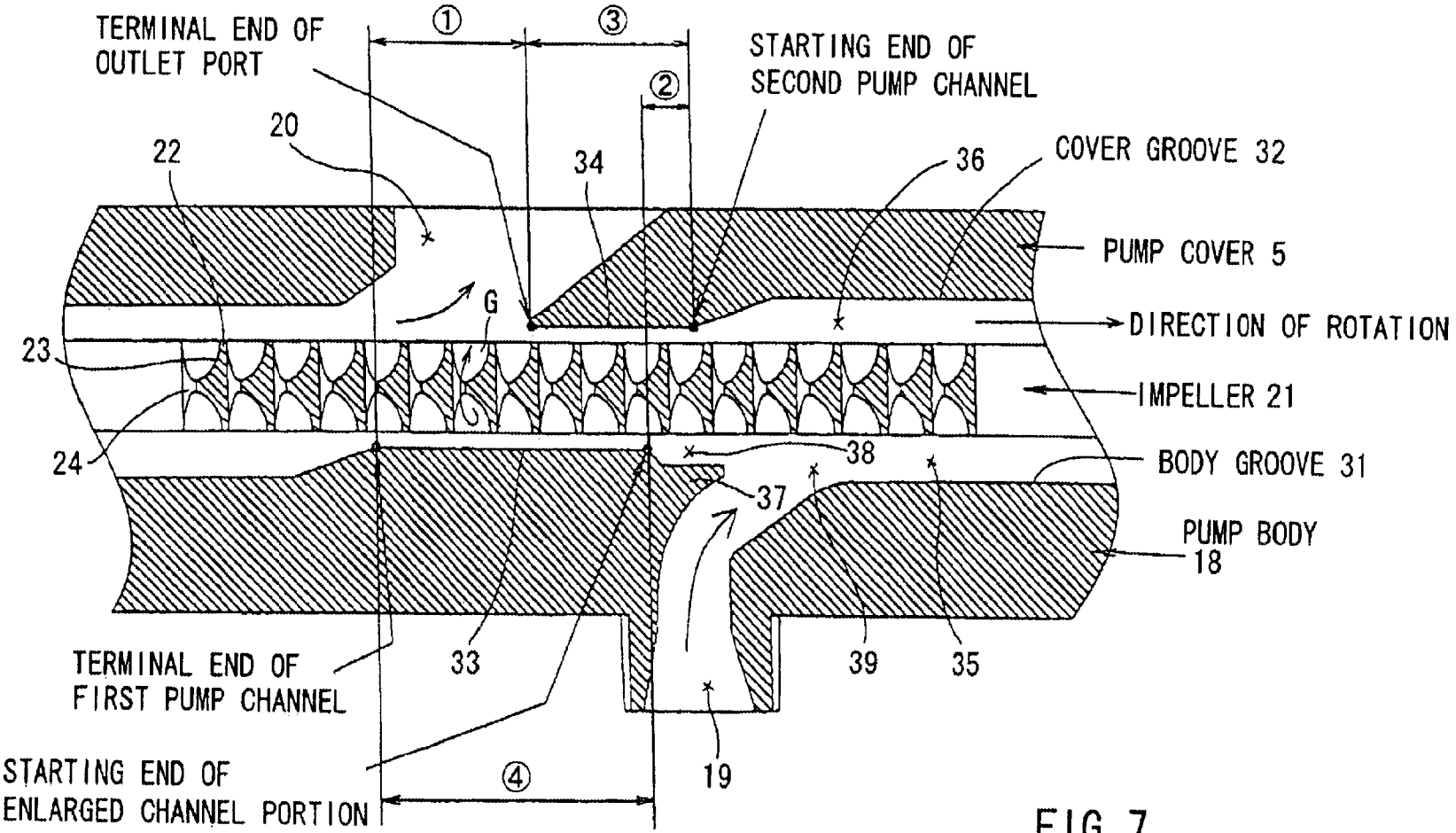
FIG. 7 is a sectional view taken along line VII—VII shown in FIG. 6.
Figure 8:
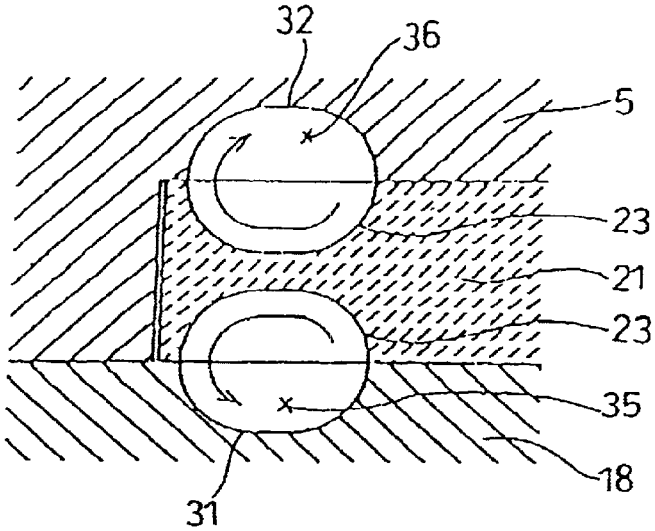
FIG. 8 is a sectional view taken along line VIII—VIII shown in FIG. 4.
Figure 9:
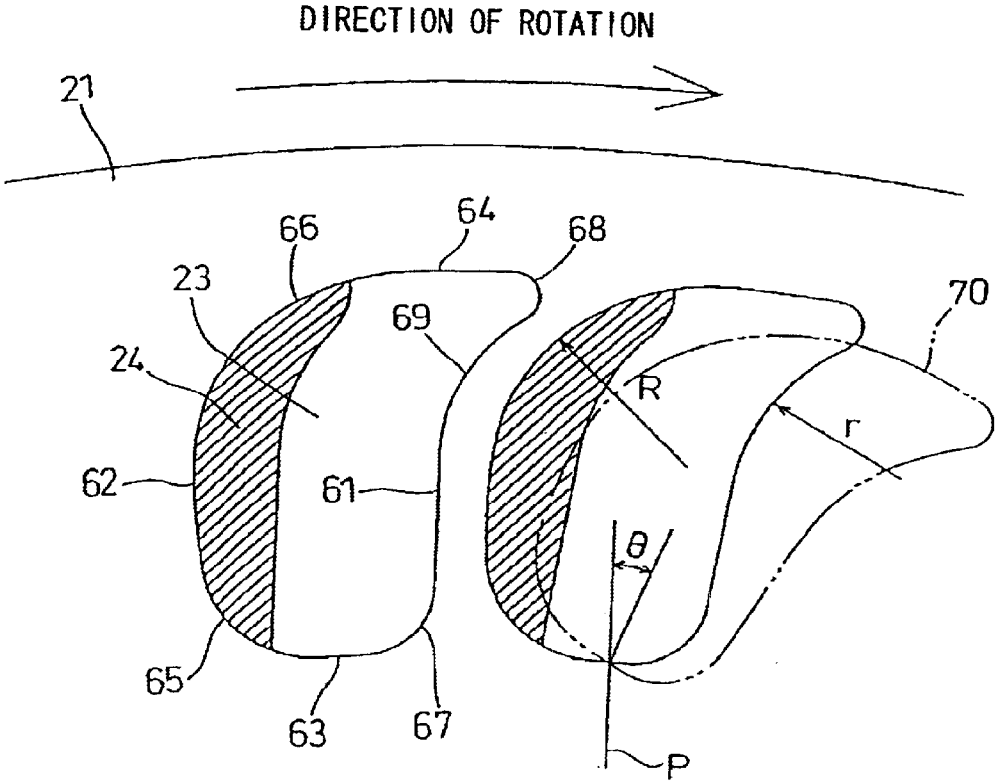
FIG. 9 is a plan view of an opening of the impeller.

FIG. 1 is a view of a representative embodiment, showing an in-tank fuel pump for a vehicle that comprises a fluid pump according to the present invention. FIG. 2 is a sectional view taken along line II—II shown in FIG. 1. FIG. 3 is a sectional view taken along line III—III shown in FIG. 1. FIG. 4 is a plan view as viewed from one axial side of an impeller. FIG. 5 is a plan view as viewed from the other axial side of the impeller. FIG. 6 is a sectional view taken along line VI—VI shown in FIG. 1. FIG. 7 is a sectional view taken along line VII—VII shown in FIG. 6. FIG. 8 is a sectional view taken along line VIII—VIII shown in FIG. 4 (a sectional view taken along the radial direction of the impeller). FIG. 9 is a plan view of an opening of the impeller.

As shown in FIG. 1, the fuel pump includes a motor section 1 and a pump section 2 that are disposed within a cylindrical housing 3. A motor cover 4 and a pump cover 5 are fixedly attached to the upper end (the upper portion in FIG. 1) and the lower end (the lower portion in FIG. 1) of the housing 3, respectively.

Bearings 9 and 10 support an upper end portion and a lower end portion of a shaft 8 of an armature 7 of the motor section 1, which are disposed within the motor cover 4 and the pump cover 5, respectively. Thus, the armature 7 is rotatably disposed within a motor receiving portion 6. A plurality of commutator segments 12 are disposed in the armature 7 and are insulated from each other. The commutator segments 12 are primarily formed of copper or silver and are connected to the coil of the armature 7. A magnet 11 is disposed on the inner peripheral surface of the housing 3.

A brush 13 and a spring 14 are disposed within the motor cover 4. The brush 13 contacts and slides along the commutator segments 12 of the armature 7. The spring 14 urges the brush 13 toward the commutator segments 12. The brush 13 is connected to an outside connecting terminal via a choke coil 15. A check valve 17 is disposed within a discharge port 16 that is formed in the motor cover 4. A fuel supply pipe (not shown) is connected to the discharge port 16.

A pump body 18 is secured to the lower end of the housing 3 below the pump cover 5 by caulking. The pump cover 5 and the pump body 18 form a pump housing. The pump cover 5 and the pump body 18 may be formed, for example, of die-cast aluminum.

A disc-like impeller 21 is rotatably disposed within the pump housing. The impeller 21 has a plurality of blade grooves 23 that are formed within both axial end surfaces of the impeller 21 and along the perimeter of the impeller 21. The impeller 21 is fitted around and connected to the shaft 8 of the armature 7. The impeller 21 may be formed, for example, of phenol resin.

Fuel flows in through an inlet port 19 that is formed on one axial side of the impeller 21 (in the pump body 18 under the impeller 21 in FIG. 1) in the pump housing. Further, fuel flows out through an outlet port 20 that is formed on the other axial side of the impeller 21 (in the pump cover 5 on the impeller 21 in FIG. 1). As shown in FIGS. 2 and 3, the inlet port 19 and the outlet port 20 are disposed in a position separated from each other in the circumferential direction of the impeller 21. A body groove 31 is formed on one axial side of the impeller 21 (in the pump body 18 under the impeller 21 in FIG. 1). The body groove 31 extends between the inlet port 19 and the outlet port 20 along the travelling path of the blade grooves of the impeller 21. In addition, a cover groove 32 is formed on the other axial side of the impeller 21 (in the pump cover 5 on the impeller 21 in FIG. 1). The cover groove 32 extends between the inlet port 19 and the outlet port 20 along the travelling path of the blade grooves of the impeller 21. Further, as shown in FIG. 7, a partition 33 is formed on one axial side of the impeller 21 (on the side of the body groove 31), and a partition 34 is formed on the other axial side of the impeller 21 (on the side of the cover groove 32). The body groove 31 and the cover groove 32 define a first pump channel 35 and a second pump channel 36. The first pump channel 35 and the second pump channel 36 extend between the inlet port 19 and the outlet port 20 along the travelling path of the blade grooves that are formed along the perimeter of the impeller 21. The partitions 33 and 34 partition the body groove 31 and the cover groove 32, respectively, between the outlet port 20 and the inlet port 19.

The pump channels 35 and 36 correspond to a first pump channel and a second pump channel of the present invention, respectively.

A blocking wall 37 extends from the wall surface of the partition 33 formed on the side of the inlet port 19 of the pump body 18 and protrudes in the direction of rotation of the impeller 21 (to the right as viewed in FIG. 7). The first pump channel 35 communicates with the inlet port 19 at a channel communicating portion 39. The blocking wall 37 extends from the partition 33 into the channel communicating portion 39 in the direction of rotation of the impeller 21. The blocking wall 37 is contiguous with the entire peripheral wall surface of the inlet port 19 except a wall portion defining the channel communicating portion 39. The blocking wall 37 may be integrally formed with the pump body 18. Alternatively, the blocking wall 37 may be separately formed in advance and fixedly attached to the pump body 18. Further, the blocking wall 37 defines a enlarged channel portion 38 between the partition 33 and the channel communicating portion 39. The enlarged channel portion 38 has a larger flow passage area than the flow passage area that is by the partitions 33 and 34.

The construction of the impeller 21 will now be explained. As shown in FIGS. 4 and 5, blades 22 are formed within both axial end surfaces of the impeller and are disposed along the perimeter of the impeller. Blade grooves 23 are formed between each of the blades 22.

As shown in FIG. 8, each of the blade grooves 23 may have a curved section with respect to the radial direction of the impeller 21. Further, as shown in FIG. 7, the blade groove 23 has a curved section with respect to the circumferential direction of the impeller 21, which curved section is inclined rearward in the direction of rotation of the impeller 21. For example, it has an inclined circular or elliptical shape.

By thus forming the blade groove 23 having a curved section with respect to the circumferential direction of the impeller 21, the pump efficiency can be increased. Specifically, as shown by arrows in FIG. 8, when fuel flows from the inlet port 19 to the outlet port 20, the fuel flows outward in the radial direction along the blade grooves 23 of the impeller 21 and collides with the radially outwardly protrusions of the wall surfaces of the body groove 31 and the cover groove 32. Then, the fuel flows inward in the radial direction along the wall surfaces of the body groove 31 and the cover groove 32 and again flows outward in the radial direction along the blade grooves 23. Thus, an eddy flow is generated. The velocity of the eddy flow in the circumferential direction is less than the peripheral velocity of the impeller 21. Therefore, after the fuel has moved inward in the radial direction along the body groove 31 and the cover groove 32, the fuel flows into blade grooves 23 located rearward in the direction of rotation of the impeller 21. In this embodiment, because each of the blade grooves 23 has a curved section with respect to the circumferential direction of the impeller 21, fluid resistance in the blade grooves 23 is reduced in the circumferential direction, thereby enhancing the pump efficiency.

As shown in FIG. 9, an opening of each of the blade grooves 23 includes four opening edge portions 61, 62, 63 and 64. The opening edge portion 61 is located forward in the direction of rotation of the impeller (on the right side as viewed in FIG. 9) and extends in the radial direction. The opening edge portion 62 is located rearward in the direction of rotation of the impeller (on the left side as viewed in FIG. 9) and extends in the radial direction. The opening edge portion 63 is located inward in the radial direction of the impeller (on the lower side as viewed in FIG. 9) and extends in the circumferential direction. The opening edge portion 64 is located outward in the radial direction of the impeller (on the upper side as viewed in FIG. 9) and extends in the circumferential direction. A meeting portion 65 between the opening edge portions 62 and 63, a meeting portion 66 between the opening edge portions 62 and 64, a meeting portion 67 between the opening edge portions 61 and 63, meeting portions 68 and 69 between the opening edge portions 61 and 64, and the opening edge portion 62 each have a curved shape. In this embodiment, the meeting portion 66 has a circular shape having a radius R in the direction of rotation of the impeller. The meeting portion 69 has a circular shape having a radius r in the direction of rotation of the impeller. By thus forming the opening edge portion of the opening of the blade groove 23 and the meeting portions of the opening edge portions with a curved shape, the pump efficiency can be increased. Specifically, because the meeting portion 65 between the opening edge portions 62 and 63 has a curved shape, fuel smoothly flows into the blade groove 23 and thus can be prevented from flowing backward. Further, because the opening edge portion 62 has a curved shape, the eddy flow discharged from the blade grooves 23 can smoothly change its direction, so that the velocity vector in the circumferential direction can be readily generated. Further, because the meeting portion 67 between the opening edge portions 61 and 63 and the meeting portions 68 and 69 between the opening edge portions 61 and 64 have a curved shape, fluid resistance can be reduced, which increases the pump efficiency.

In addition, the opening of the blade groove 23 may be tilted in the radial direction of the impeller. For example, as shown by dotted line 70 in FIG. 9, the opening may be formed in a position rotated forward in the direction of rotation of the impeller by an angle of θ with respect to a radial line P. Also in this case, fluid resistance can be reduced.

Communicating holes 24 may each extend between the rear portions (the left portions as viewed in FIGS. 7 and 9), which are located rearward in the direction of rotation of the impeller, of each back-to-back pair of the blade grooves 23 that are formed within both axial end surfaces of the impeller 21. The shape and size of the communicating holes 24 can be determined appropriately. By thus forming the communicating holes 24 between the rear portions of the back-to-back pairs of the blade grooves 23 formed in the both end surfaces, the pump efficiency can be increased. Specifically, because the eddy flow is generated within the blade grooves 23 in the rear in the direction of rotation, the pressure increases within the blade grooves 23 in the rear in the direction of rotation. Therefore, as shown by arrow G in FIG. 7, when the blade grooves 23 reach a position that faces the outlet port 20, the fuel can be more easily and smoothly drawn out of the blade grooves 23 formed on the side opposite to the side of the outlet port 20 into communicating holes 24 and the fuel is discharged from the outlet port 20 through the communicating holes 24. As a result, the pump efficiency can be increased. Vapor is generated when the temperature of the fuel rises. If the vapor is drawn into the first pump channel 35 or the second pump channel 36 through the inlet port 19 and enters the blade grooves 23, the pump efficiency will be reduced. Therefore, a vapor discharge port is typically provided in the body groove 31 or the cover groove 32 so that vapor within the blade grooves 23 is discharged through the vapor discharge port. In this embodiment, because the communicating holes 24 extend between the blade grooves 23 that are formed within both axial end surfaces of the impeller 21, the vapor within the blade grooves 23 can be discharged more efficiently. Specifically, vapor within the blade grooves 23 formed on the side opposite to the side of the vapor discharge port is directed into the blade grooves 23 formed on the side of the vapor discharge port through the communicating holes 24. As a result, vapor can be more efficiently discharged from the blade grooves 23 formed on the side opposite to the side of the vapor discharge port, which improves the pump efficiency.

The fuel pump thus constructed operates as follows.

When the motor section 1 is energized, the shaft 8 rotates and thus the impeller 21 rotates. Thus, fuel is drawn from a fuel tank (not shown) into the inlet port 19 and flows toward the outlet port 20 along the first pump channel 35 or the second pump channel 36 via the blade grooves 23 of the impeller 21. When the fuel reaches the outlet port 20, the fuel is discharged into the motor receiving portion 6 through the outlet port 20. At this time, fuel within the second pump channel 36 is directly discharged through the outlet port 20. Further, fuel within the first pump channel 35 is drawn into the second pump channel 36 by pressing against the wall of the terminal end of the body groove 31. Then, the fuel is discharged through the outlet port 20.

If the peripheral velocity of the impeller 21 is higher than the flow velocity at which the fuel within the first pump channel 35 flows toward the outlet port 20, the fuel within the first pump channel 35 will not be discharged through the outlet port 20. Such fuel will be confined within the blade grooves 23 and will flow toward the inlet port 19. As a result, the pump efficiency will be reduced.

In this respect, the distance between the terminal end of the outlet port 20 and the terminal end of the first pump channel 35 may be adjusted, so that the fuel within the first pump channel 35 can be reliably discharged through the outlet port 20 even when the peripheral velocity of the impeller 21 is higher. Therefore, in the present embodiment, the pump efficiency is increased by adjusting the distance between the terminal end of the outlet port 20 and the terminal end of the first pump channel 35.

Figure 10:
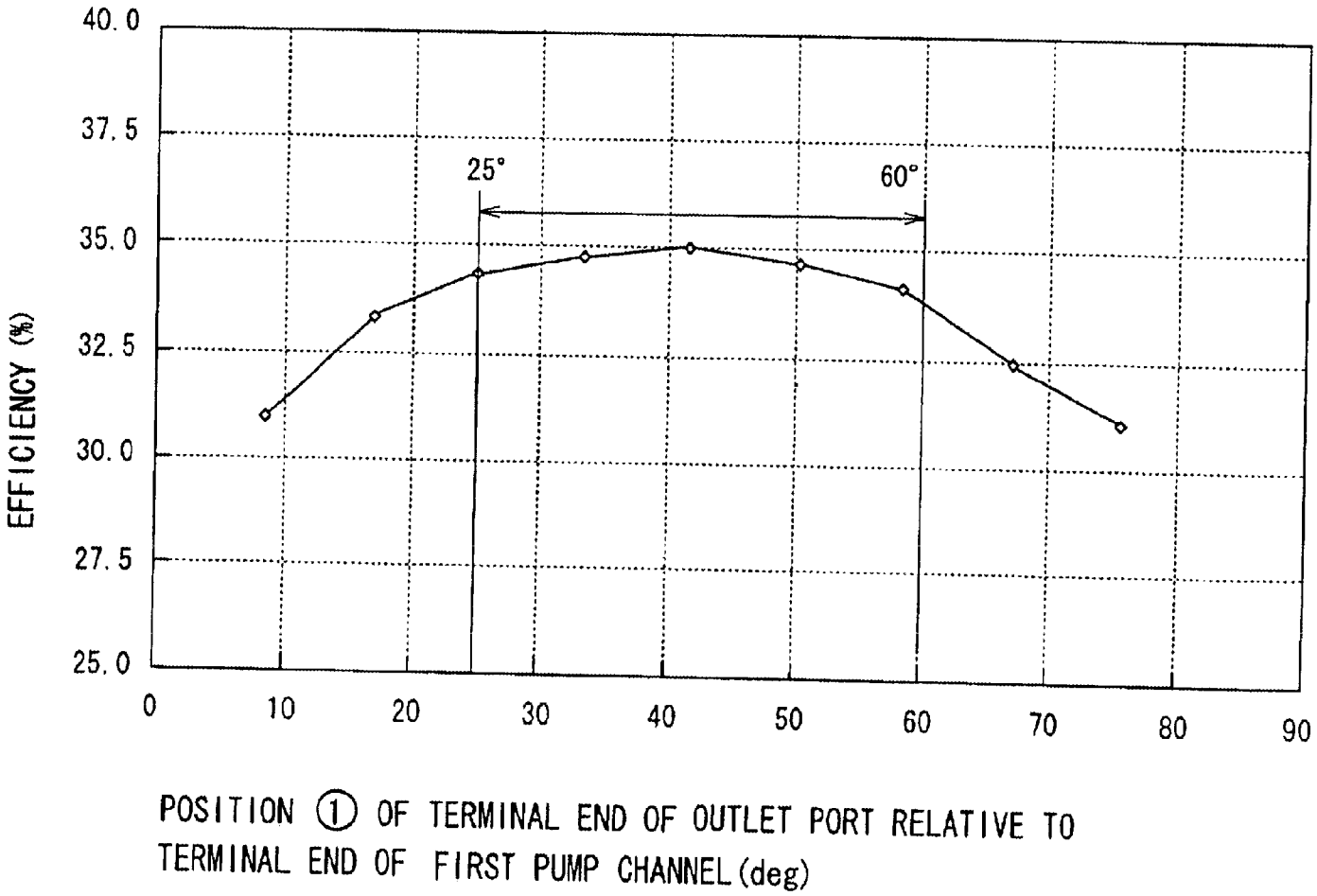
FIG. 10 is a graph showing the relationship between the pump efficiency and the distance from the terminal end of the first pump channel to the terminal end of the outlet port.

FIG. 10 shows the relationship between the pump efficiency and the distance ① (see FIGS. 6 and 7) between the terminal end of the first pump channel 35 and the terminal end of the outlet port 20. The terminal end of the outlet port 20 is located forward (downstream) of the terminal end of the first pump channel 35 in the direction of rotation of the impeller 21. The data shown in FIG. 10 was obtained by conducting an experiment using a fuel pump that has an impeller 21 having a thickness of 3.8 mm and an outer diameter of 33 mm. In the experiment, the fuel pump was operated at a motor supply voltage of 12 V, a fuel pressure of 324 kPa, a fuel discharge rate of 100 liters/hr, and a rotational speed of 7000 rpm. The pump efficiency was obtained from the following equation:

$$\text{pump efficiency}=g\times(P\times Q)/(T\times N),$$

wherein g represents acceleration, T represents the motor torque, N represents the rotational speed, P represents the fuel pressure, and Q represents the fuel discharge rate.

As shown in FIG. 10, improved pump efficiency can be obtained when the distance (angle in FIG. 10) ① between the terminal end of the first pump channel 35 and the terminal end of the outlet port 20 is chosen to be between about 25° to 60°. With the above-noted specifications, the best pump efficiency can be obtained when the angle ① between the terminal end of the first pump channel 35 and the terminal end of the outlet port 20 is about 42°. In this embodiment, the pump efficiency can be increased by a maximum of about 1%.

Further, some of the fuel within the blade grooves 23 is not discharged through the outlet port 20. The fuel is confined within the blade grooves 23 by the partitions 33 and 34. In this state, the fuel is highly pressurized and passes along the partitions 33 and 34. When the blade grooves 23 confining the high-pressure fuel reaches the channel communicating portion 39 at which the first pump channel 35 communicates with the inlet port 19, or the starting end of the second pump channel 36, the high-pressure fuel within the blade grooves 23 is ejected into the channel communicating portion 39 or the second pump channel 36. If the high-pressure fuel that has been ejected into the channel communicating portion 39 flows back into the inlet port 19, the high-pressure fuel will collide with fuel flowing in through the inlet port 19. This collision will cause a reduction of the amount of fuel that flows in through the inlet port 19, which reduces the pump efficiency.

In this respect, the high-pressure fuel may be prevented from flowing back into the inlet port 19, thereby preventing the high-pressure fuel from colliding with fuel flowing in through the inlet port 19. Therefore, in the present embodiment, the enlarged channel portion 38 is provided in the partition 33 of the pump body 18 on the side of the inlet port 19 in order to prevent the high-pressure fuel from flowing back into the inlet port 19. Thus, the amount of fuel that flows in through the inlet port 19 is not reduced.

As shown in FIG. 7, in the present embodiment, a blocking wall 37 extends from the wall surface of the partition 33 of the pump body 18 on the side of the inlet port 19 (forward in the direction of rotation of the impeller). The blocking wall 37 has a stepped shape with respect to the partition 33. Thus, the enlarged channel portion 38 is defined between the partition 33 and the channel communicating portion 39. The enlarged channel portion 38 has a larger flow passage area than the flow passage area that is reduced by the partitions 33 and 34. The configuration of the blocking wall 37 may be varied, and the flow passage area of the enlarged channel portion 38 also may be varied. For example, the blocking wall 37 may have a plate-like shape, or may have an inclined wall surface that is formed along the inlet port 19 and inclined in the direction of rotation of the impeller 21 from the side of the inlet port 19 toward the channel communicating portion 39. Further, a wall surface of the channel communicating portion 39 that faces the blocking wall 37 may preferably comprise an inclined surface that is inclined in the direction of rotation of the impeller 21 from the side of the inlet port 19 toward the first pump channel 35.

When the high-pressure fuel that has been confined within the blade grooves 23 passes along the partition 33 and reaches the enlarged channel portion 38, the fuel is ejected into the enlarged channel portion 38. Then, the fuel is directed to the channel communicating portion 39 along the blocking wall 37 that defines the enlarged channel portion 38. Thus, the high-pressure fuel that has been confined within the blade grooves 23 can be prevented from flowing back into the inlet port 19, thereby preventing a reduction of the amount of fuel that flows in through the inlet port 19. As a result, the pump efficiency is increased.

Further, if the distance between the starting end of the enlarged channel portion 38 and the starting end of the second pump channel 36 is close, the high-pressure fuel that has been confined within the blade grooves 23 will pass along the partitions 33 and 34 and then will be ejected substantially at the same time into the enlarged channel portion 38 and the second pump channel 36. In this case, the ejecting pressures of the high-pressure fuel that is ejected into the enlarged channel portion 38 and thus into the channel communicating portion 39 will be reduced. If the ejecting pressure of the high-pressure fuel that is ejected into the channel communicating portion 39 is reduced, negative pressure will be reduced in the channel communicating portion 39 on the side of the inlet port 19, thereby reducing the amount of fuel that flows in through the inlet port 19.

In this respect, the ejecting pressures of the high-pressure fuel that is ejected into the enlarged channel portion 38 and thus into the channel communicating portion 39 can be increased by adjusting the distance between the starting end of the enlarged channel portion 38 and the starting end of the second pump channel 36. Therefore, in the present embodiment, the distance between the starting end of the enlarged channel portion 38 and the starting end of the second pump channel 36 is adjusted in order to prevent a reduction of the negative pressure in the channel communicating portion 39 on the side of the inlet port 19.

Figure 11:
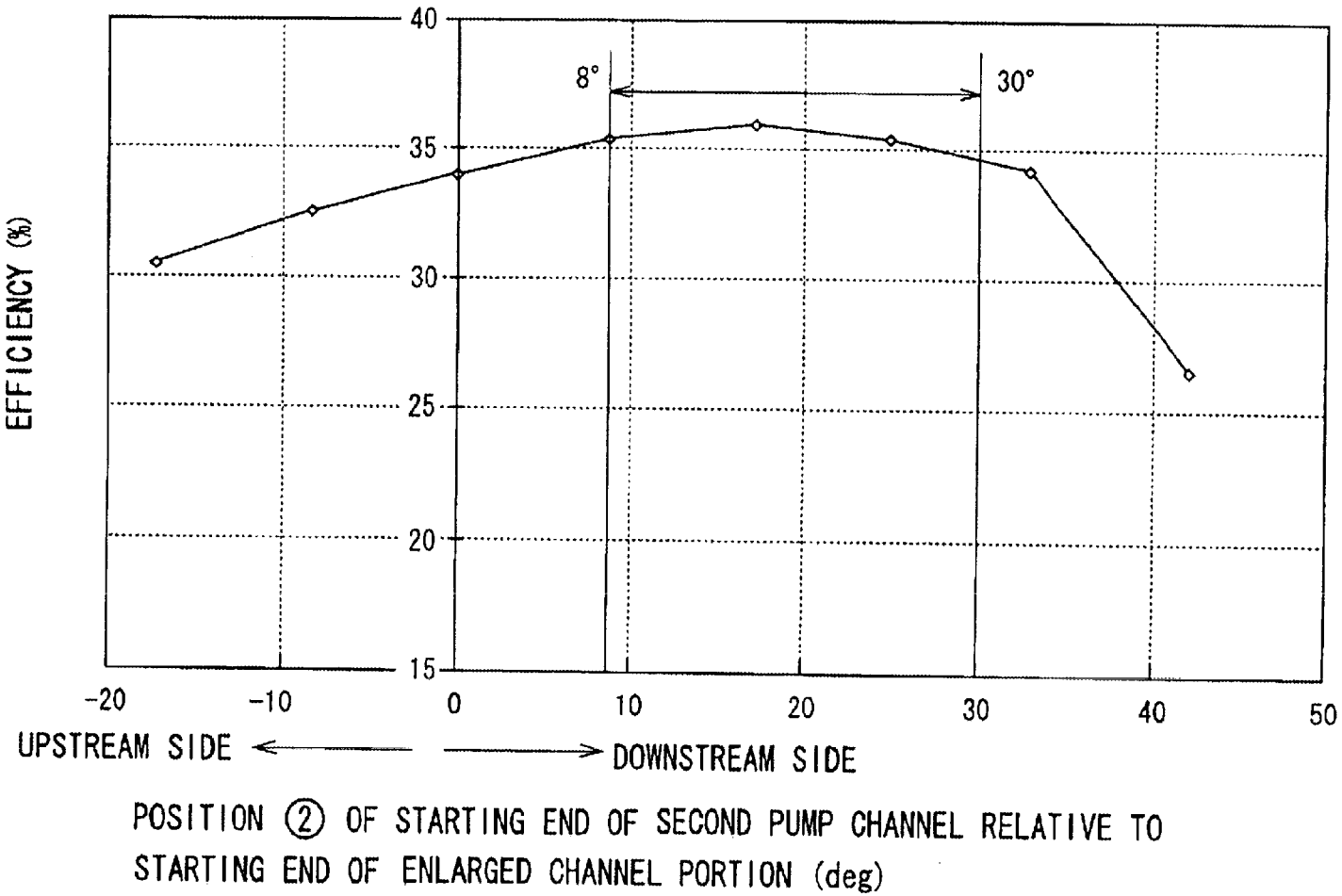
FIG. 11 is a graph showing the relationship between the pump efficiency and the distance from the starting end of the enlarged channel portion to the starting end of the second pump channel.

FIG. 11 shows the relationship between the pump efficiency and the distance ② (see FIGS. 6 and 7) from the starting end of the enlarged channel portion 38 to the starting end of the second pump channel 36. The starting end of the second pump channel 36 is located forward of the starting end of the enlarged channel portion 38 in the direction of rotation of the impeller 21. The data shown in FIG. 11 was obtained by using a fuel pump having the same specifications as the above-mentioned fuel pump used in the experiment of FIG. 10.

As shown in FIG. 11, improved pump efficiency can be obtained when the distance (angle in FIG. 11) ② between the starting end of the enlarged channel portion 38 and the starting end of the second pump channel 36 is chosen to be between about 8° to 30°. With the above-noted specifications, the best pump efficiency can be obtained when the angle ② between the starting end of the enlarged channel portion 38 and the starting end of the second pump channel 36 is about 17°. In this embodiment, the pump efficiency can be increased by a maximum of about 0.5%.

Further, if the flow passage lengths of the pump channels 35 and 36 are increased, the pump efficiency will be increased. On the other hand, when the flow passage lengths of the pump channels 35 and 36 are increased, the lengths (sealing widths) of the partitions 33 and 34 are shortened if the circumferential length of the impeller 21 is not changed. If the lengths of the partitions 33 and 34 are shortened, an increased amount of fuel will leak from the outlet port side to the inlet port side via the partitions 33 and 34 due to the fuel pressure difference between the outlet port side and the inlet port side of the partitions 33 and 34. As a result, the pump efficiency will be reduced. In this respect, the pump efficiency can be changed by varying the lengths (sealing widths) of the partitions 33 and 34 or the relationship between the lengths (sealing widths) of the partitions 33 and 34 and the flow passage lengths of the pump channels 35 and 36.

Figure 12:
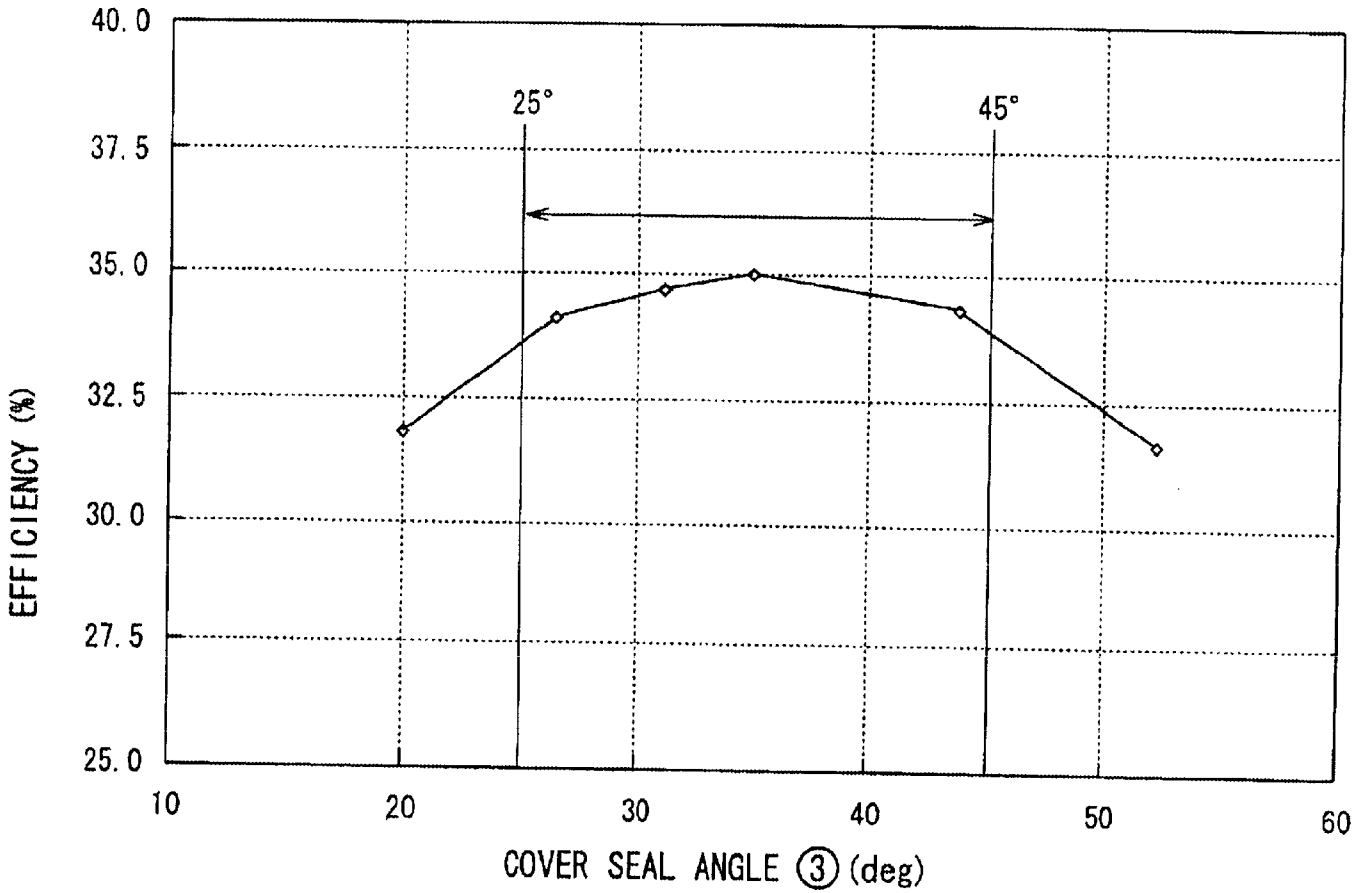
FIG. 12 is a graph showing the relationship between the pump efficiency and the cover seal angle.

Therefore, in the present embodiment, the flow passage length of the second pump channel 36 and the length (sealing width) of the partition 34 are adjusted in order to increase the pump efficiency. FIG. 12 shows the relationship between the pump efficiency and the length ③ (see FIGS. 6 and 7) of the partition 34 formed on the side of the pump cover 5. The data shown in FIG. 12 was obtained by using a fuel pump having the same specifications as the above-mentioned fuel pump used in the experiment of FIG. 10.

As shown in FIG. 12, when the length of the partition 34 (cover seal angle of the partition 34 in FIG. 12) ③ is chosen to be between about 25° to 45°, the relationship between the length (sealing width) of the partition 34 and the flow passage length of the second pump channel 36 can be optimized, so that the pump efficiency can be increased.

Figure 13:
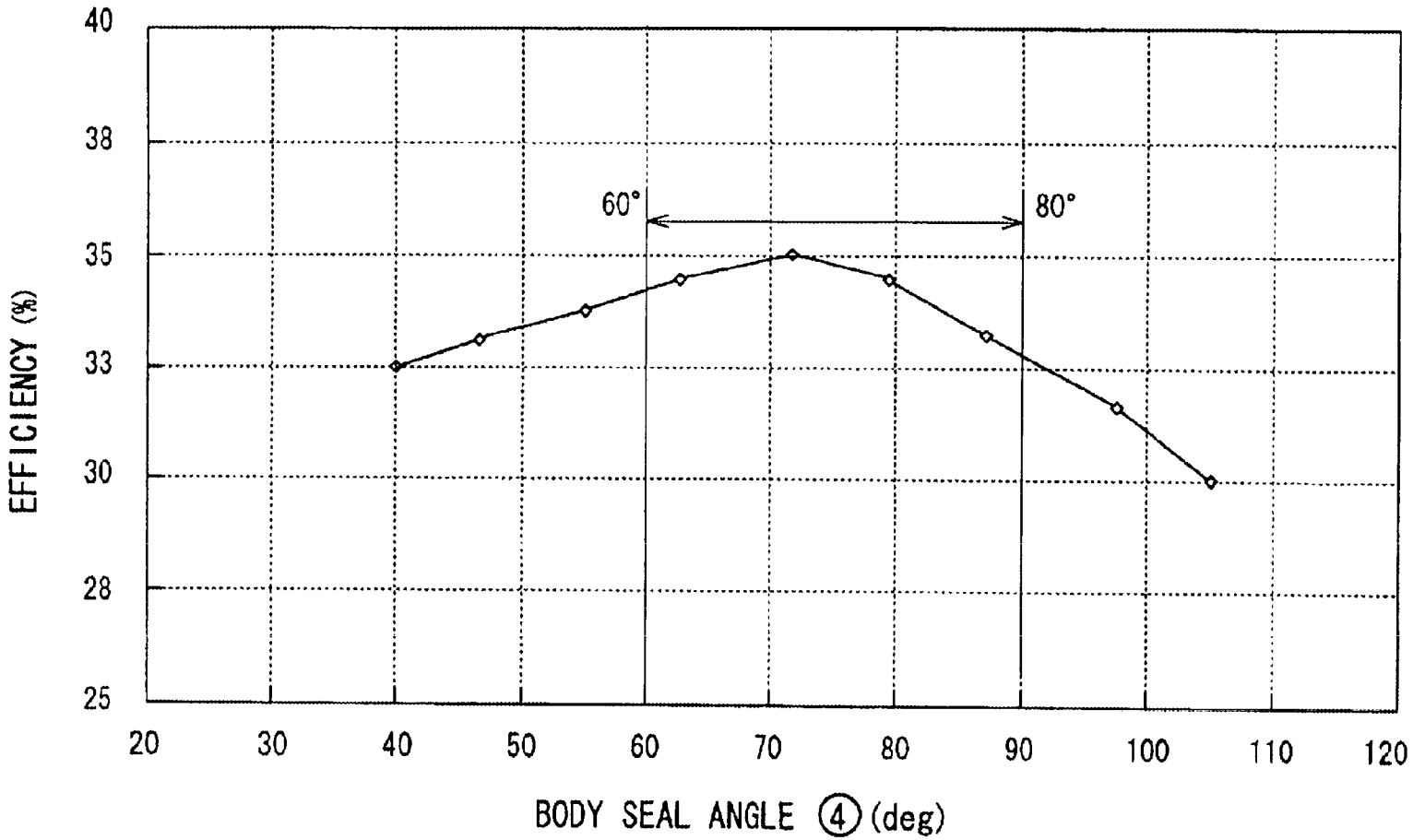
FIG. 13 is a graph showing the relationship between the pump efficiency and the body seal angle.

Further, in this embodiment, the flow passage length of the first pump channel 36 and the length (sealing width) of the partition 33 are adjusted so that the pump efficiency can be increased. FIG. 13 shows a relationship between the pump efficiency and the length ④ (see FIGS. 6 and 7) of the partition 33 formed on the side of the pump body 18. The data shown in FIG. 13 was obtained by using a fuel pump having the same specifications as the abovementioned fuel pump used in the experiment of FIG. 10. In this case, the pressure difference between the outlet port side and the inlet port side of the partition 33 is larger than the pressure difference between the outlet port side and the inlet port side of the partition 34, due to negative pressure developed by the existence of the inlet port 19. Therefore, the length of the partition 33 is required to be longer than the length of the partition 34.

As shown in FIG. 13, when the length of the partition 33 (body seal angle of the partition 33 in FIG. 13) ④ is chosen to be between about 60° to 80°, the relationship between the length (sealing width) of the partition 33 and the flow passage length of the first pump channel 35 can be optimized, so that the pump efficiency can be increased.

In the above-mentioned embodiment, the pump efficiency was described as being increased by adjusting the distance ① between the terminal end of the first pump channel 35 and the terminal end of the outlet port 20, the distance ② between the starting end of the enlarged channel portion 38 and the starting end of the second pump channel 36, the cover seal angle ③ and the body seal angle ④. However, the pump efficiency can be also increased by adjusting only one or some of ① to ④.

Further, although a fuel pump for supplying fuel was described in this specification, the present invention may be applied to a fluid pump for supplying various kinds of fluids other than fuel.

The present invention is not limited to the constructions that have been described as the representative embodiment, but rather, may be added to, changed, replaced with alternatives or otherwise modified without departing from the spirit and scope of the invention.

What is claimed is:

1. A fluid pump comprising:

an impeller having a first axial side and a second axial side opposite of the first axial side, wherein blade grooves are defined on the first and second axial sides along the perimeter of the impeller, and a pump housing rotatably supporting and enclosing the impeller, the pump housing comprising:

an inlet port that faces the first axial side of the impeller, an outlet port that faces the second axial side of the impeller, the impeller being disposed between the inlet port and the outlet port, a pump channel extending between the inlet port and the outlet port along a traveling path of the blade grooves, the pump channel including a first pump channel that faces the first axial side of the impeller and a second pump channel that faces the second axial side of the impeller, and a partition disposed between the inlet port and the outlet port, wherein a terminal end of the outlet port is located at a position displaced from a terminal end of the first pump channel relative to the axis of rotation of the impeller by between 25° to 60° in the rotational direction of the impeller.

2. A fluid pump as defined in claim 1, wherein the pump housing further includes a channel communication portion that couples the first pump channel to the inlet port and an enlarged channel portion defined between the partition and the channel communicating portion, the enlarged channel portion-having a larger flow passage area than a flow passage area reduced by the partition, and wherein a starting end of the second pump channel is located at a position displaced relative to the axis of rotation of the impeller between 8° to 30° from a starting end of the enlarged channel portion in the rotational direction of the impeller.

3. A fluid pump as defined in claim 2, wherein a portion of the partition that is disposed proximal to and facing the second pump channel subtends a radial arc of between 25° to 45° relative to the axis of rotation of the impeller.

4. A fluid pump as defined in claim 3, wherein a portion of the partition that is disposed proximal to and faces the first pump channel subtends a radial arc of between 60° to 80° relative to the axis of rotation of the impeller.

5. A fluid pump as defined in claim 4, wherein each of the blade grooves has a curved section with respect to a circumferential direction of the impeller and is inclined rearward in the rotational direction of the impeller.

6. A fluid pump as defined in claim 5, wherein the blade grooves each have an opening that is tilted in a radial direction of the impeller.

7. A fluid pump as defined in claim 6, further comprising a communicating hole that extends between each of back-to-back pairs of the blade grooves that are formed within both axial end surfaces of the impeller.

8. A fluid pump as defined in claim 1, wherein a portion of the partition that is disposed proximal to and facing the second pump channel subtends a radial arc of between 25° to 45° relative to the axis of rotation of the impeller.

9. A fluid pump as defined in claim 1, wherein a portion of the partition that is disposed proximal to and facing the first pump channel subtends a radial arc of between 60° to 80° relative to the axis of rotation of the impeller.

10. A fluid pump as defined in claim 1, wherein each of the blade grooves has a curved section with respect to a circumferential direction of the impeller and is inclined rearward in the rotational direction of the impeller.

11. A fluid pump as defined in claim 1, wherein the blade grooves each have an opening that is tilted in a radial direction of the impeller.

12. A fluid pump as defined in claim 1, further comprising a communicating hole that extends between each of back-to-back pairs of the blade grooves that are formed within both axial end surfaces of the impeller.

13. A fluid pump comprising:

an impeller having a first axial side and a second axial side opposite of the first axial side, wherein blade grooves are defined on the first and second axial sides along the perimeter of the impeller, and a pump housing rotatably supporting and enclosing the impeller, the pump housing comprising:

an inlet port that faces the first axial side of the impeller, an outlet port that faces the second axial side of the impeller, the impeller being disposed between the inlet port and the outlet port, a pump channel extending between the inlet port and the outlet port along traveling path of the blade grooves, the pump channel including a first pump channel that faces the first axial side of the impeller and a second pump channel that faces the second axial side of the impeller, a partition disposed between the inlet port and the outlet port, a channel communicating portion that couples the first pump channel with the inlet port and an enlarged channel portion that is defined between the partition and the channel communicating portion, the enlarged channel portion having a larger flow passage area than a flow passage area decreased by the partition, wherein a starting end of the second pump channel is located at a position displaced relative to the axis of rotation of the impeller between 8° to 30° from a starting end of the enlarged channel portion in the rotational direction of the impeller.

14. A fluid pump as defined in claim 13, where in a portion of the partition that is disposed proximal to and facing the second pump channel subtends a radial arc of between 25° to 45° relative to the axis of rotation of the impeller.

15. A fluid pump as defined in claim 14, wherein a portion of the partition that is disposed proximal to and facing the first pump channel subtends a radial arc of between 60° to 80° relative to the axis of rotation of the impeller.

16. A fluid pump as defined in claim 13, wherein a portion of the partition that is disposed proximal to and facing the first pump channel subtends a radial arc of between 60° to 80° relative to the axis of rotation of the impeller.

17. A fluid pump as defined in claim 13, wherein each of the blade grooves has a curved section with respect to a circumferential direction of the impeller and is inclined rearward in the rotational direction of the impeller.

18. A fluid pump as defined in claim 13, wherein the blade grooves each have an opening that is tilted in a radial direction of the impeller.

19. A fluid pump as defined in claim 13, further comprising a communicating hole that extends between each of back-to-back pairs of the blade grooves that are formed within both axial end surfaces of the impeller.

20. A fluid pump comprising:

an impeller having a first axial side and a second axial side opposite of the first axial side, wherein blade grooves are defined on the first and second axial sides along the perimeter of the impeller, and a pump housing rotatably supporting and enclosing the impeller, the pump housing comprising:

an inlet port that faces the first axial side of the impeller, an outlet port that faces the second axial side of the impeller, the impeller being disposed between the inlet port and the outlet port, a pump channel extending between the inlet port and the outlet port along a traveling path of the blade grooves, the pump channel including a first pump channel that faces the first axial side of the impeller and a second pump channel that faces the second axial side of the impeller, and a partition disposed between the inlet port and the outlet port, wherein a portion of the partition that is disposed proximal to and facing the second pump channel subtends a radial arc of between 25° to 45° relative to the axis of rotation of the impeller.

21. A fluid pump as defined in claim 20, wherein a portion of the partition that is disposed proximal to and faces the first pump channel subtends a radial arc of between 60° to 80° relative to the axis of rotation of the impeller.

22. A fluid pump as defined in claim 21, wherein a terminal end of the outlet port is located at a position displaced relative to the axis of rotation of the impeller from a terminal end of the first pump channel by between 25° to 60° in the rotational direction of the impeller.

23. A fluid pump comprising:

an impeller having a first axial side and a second axial side opposite of the first axial side, wherein blade grooves are defined on the first and second axial sides along the perimeter of the impeller, and a pump housing rotatably supporting and enclosing the impeller, the pump housing comprising:

an inlet port that faces the first axial side of the impeller, an outlet port that faces the second axial side of the impeller, the impeller being disposed between the inlet port and the outlet port, a pump channel extending between the inlet port and the outlet port along a traveling path of the blade grooves, the pump channel including a first pump channel that faces the first axial side of the impeller and a second pump channel that faces the second axial side of the impeller, and a partition disposed between the inlet port and the outlet port, wherein a portion of the partition that is disposed proximal to and facing the first pump channel subtends a radial arc of between 60° to 80° relative to the axis of rotation of the impeller.

24. A fluid pump as defined in claim 23, further comprising:

a channel communicating portion that couples the first pump channel with the inlet port and an enlarged channel portion that is defined between the partition and the channel communicating portion, the enlarged channel portion having a larger flow passage area than a flow passage area decreased by the partition, wherein a starting end of the second pump channel is located at a position displaced relative to the axis of rotation of the impeller between 8° to 30° from a starting end of the enlarged channel portion in the rotational direction of the impeller and wherein a terminal end of the outlet port is located at a position displaced relative to the axis of rotation of the impeller from a terminal end of the first pump channel by between 25° to 60° in the rotational direction of the impeller.

25. A fluid pump as defined in claim 20, wherein each of the blade grooves has a curved section with respect to a circumferential direction of the impeller.

26. A fluid pump as defined in claim 23, wherein each of the blade grooves has a curved section with respect to a circumferential direction of the impeller.

* * * * *

UNITED STATES PATENT AND TRADEMARK OFFICE

CERTIFICATE OF CORRECTION

PATENT NO. : 6,659,713 B1
DATED : December 9, 2003
INVENTOR(S) : Shinichi Fujii et al.

It is certified that error appears in the above-identified patent and that said Letters Patent is hereby corrected as shown below:

Title page,
Item [73], Assignee, change "AISIN KOGYO KABUSHIKI KAISHA" to -- AISAN KOGYO KABUSHIKI KAISHA --

Signed and Sealed this

Twenty-second Day of June, 2004

JON W. DUDAS
*Acting Director of the United States Patent and Trademark Office*